US011053730B1

(12) United States Patent
Camarillo

(10) Patent No.: US 11,053,730 B1
(45) Date of Patent: Jul. 6, 2021

(54) BLACKOUT WINDOW COVERING SYSTEM

(71) Applicant: Juan Carlos Camarillo, Dallas, TX (US)

(72) Inventor: Juan Carlos Camarillo, Dallas, TX (US)

( * ) Notice: Subject to any disclaimer, the term of this patent is extended or adjusted under 35 U.S.C. 154(b) by 85 days.

(21) Appl. No.: 16/561,209

(22) Filed: Sep. 5, 2019

(51) Int. Cl.
*E06B 9/00* (2006.01)
*E06B 9/24* (2006.01)

(52) U.S. Cl.
CPC ..... *E06B 9/24* (2013.01)

(58) Field of Classification Search
CPC ..... E04B 9/24; E04G 21/32; E06N 3/26
USPC ..... 160/368.1; 52/202
See application file for complete search history.

(56) References Cited

U.S. PATENT DOCUMENTS 2,514,316 A * 7/1950 Dobrin ..... E06B 3/285 160/102
3,251,399 A * 5/1966 Grossman ..... E06B 3/285 160/180
3,668,808 A * 6/1972 Perina ..... E06B 3/5807 49/465
3,753,458 A * 8/1973 Lazarek ..... E06B 9/521 160/354
4,068,428 A * 1/1978 Peterson, III ..... E06B 3/28 160/354
4,249,589 A * 2/1981 Loeb ..... E06B 9/521 160/354
4,272,934 A * 6/1981 Cowden ..... E06B 3/28 52/202
4,409,758 A * 10/1983 Dickerson ..... E06B 3/28 160/231.2
4,562,675 A * 1/1986 Baigas, Jr. ..... E06B 3/285 160/354
4,802,523 A * 2/1989 Scholten ..... A47H 23/02 160/354
4,836,265 A * 6/1989 Bussert ..... A47H 99/00 160/354
4,867,222 A * 9/1989 Roman ..... E06B 3/285 160/89
4,971,130 A * 11/1990 Bentley ..... E06B 3/285 160/127
4,972,896 A * 11/1990 Roberts ..... A47H 23/00 160/354
5,383,312 A * 1/1995 St. Louis ..... B05B 16/40 52/63

(Continued)

*Primary Examiner* — Beth A Stephan
(74) *Attorney, Agent, or Firm* — Sanchelima & Associates, P.A.; Christian Sanchelima; Alexander Rodriguez

(57) ABSTRACT

A blackout window covering system including a shade assembly and a mounting assembly is disclosed herein. The shade assembly includes a blackout shade and loop fasteners. The blackout shade is made of fabric that is adapted to block light and noise. The shade can also be effortlessly cut by a user in order to fit the frame of a window. Furthermore, the blackout shade provides a user with increased privacy. Additionally, the loop fasteners are sowed into the black out shade to be attached to hook fasteners located on the mounting assembly. The mounting assembly includes individual rectangular mounting strips that are attached to the perimeter of a window through the use of threaded fasteners. However, one of the perimeter sides is left open to aid a user in effortlessly removing the blackout shade from the fasteners. The blackout shade can be removed and attached as needed to a window.

10 Claims, 2 Drawing Sheets

(56) References Cited

U.S. PATENT DOCUMENTS

| | | | | | |
|---|---|---|---|---|---|
| 5,427,169 | A * | 6/1995 | Saulters | E06B 3/80 | 160/332 |
| 5,850,864 | A * | 12/1998 | Decker | E06B 9/42 | 160/268.1 |
| 5,937,596 | A * | 8/1999 | Leeuwenburgh | B44D 3/00 | 52/202 |
| 6,675,860 | B2 * | 1/2004 | Steele | E06B 3/285 | 160/237 |
| 7,946,333 | B1 * | 5/2011 | Zapata | E06B 9/52 | 160/368.1 |
| 7,963,313 | B1 * | 6/2011 | Bennett | E06B 9/00 | 160/368.1 |
| 8,037,923 | B2 * | 10/2011 | Alkhoury | E06B 9/52 | 160/369 |
| 8,479,462 | B1 * | 7/2013 | Sahadeo | E06B 3/28 | 52/203 |
| 9,222,301 | B2 * | 12/2015 | Dison | E06B 9/24 | |
| 9,345,357 | B1 * | 5/2016 | Davila, Jr. | A47H 1/00 | |
| 2006/0081344 | A1 * | 4/2006 | McKearney | E06B 9/24 | 160/368.1 |

* cited by examiner

BLACKOUT WINDOW COVERING SYSTEM

BACKGROUND OF THE INVENTION

1. Field of the Invention

The present invention relates to a blackout window covering system and, more particularly, to a blackout window covering system that is easily mounted to windows to block out unwanted light and noise from outdoors.

2. Description of the Related Art

Several designs for a blackout window covering system have been designed in the past. None of them, however, include a window blackout shade and mounting system comprising a mounting strip which is placed on the wall around the perimeter of a window using threaded fasteners wherein the strip has hook and pile material on the face of it for securing a fabric blackout window covering blanket to it. It is known that windows provide a home with light from the outdoors. It is also known that the light and noise from the outside of a home can make it strenuous for a person to sleep and rest. The present invention addresses these issues by providing a blackout shade for blocking unwanted light and noise from the outdoors of a home thereby providing a user an agreeable environment to sleep and rest. The present invention also increases the privacy of a user by blocking the view to the inside of a home.

Applicant believes that a related reference corresponds to U.S. patent No. 2006/0081344 issued to Diana Mckearney for a portable blackout shade. However, it differs from the present invention because the Mckearney reference fails to provide the effectiveness and ease of use of the present invention. The present invention addresses these issues by using a mounting assembly including mounting strips and threaded fasteners to effortlessly secure the blackout shade to the window. The present invention is also configured to block out noise which the reference fails to accomplish.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a blackout window cover system including a blackout shade that is adapted to block out unwanted light and noise from outdoors to facilitate an environment indoors to help people rest and sleep.

It is another object of this invention to provide a blackout window cover system that is easily installed through a system of mounting strips and hook and loop fasteners. The mounting strips are easily attached to a window frame and can be removed and reinstalled as needed.

It is still another object of the present invention to provide a blackout window cover system including a blackout shade that increases the privacy of a user. The blackout shade blocks any view to the inside of a home thereby giving a user increased privacy.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
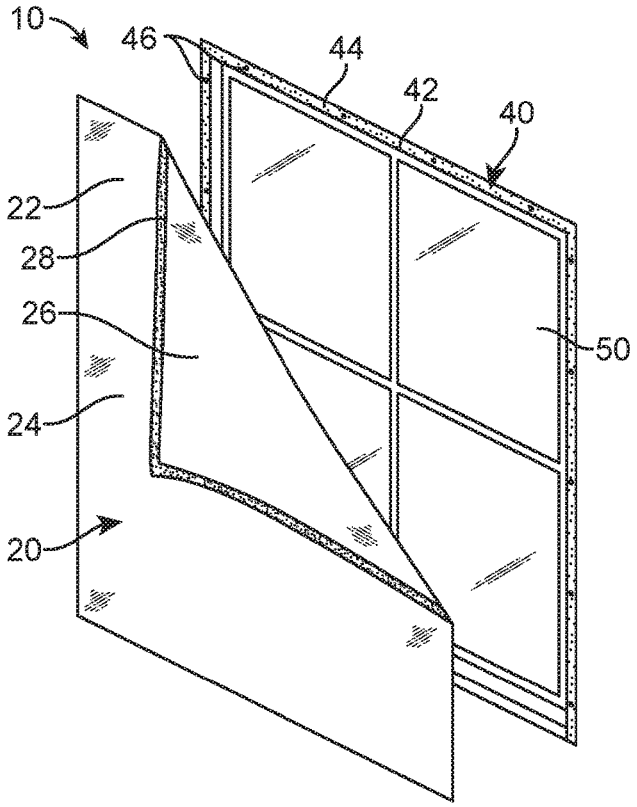
FIG. 1 represents an exploded isometric view of the present invention wherein shade assembly 20 can be seen mounting to a window 50 through mounting assembly 40 comprising mounting strips 42, hook fasteners 44, and threaded fasteners 46.
Figure 2:
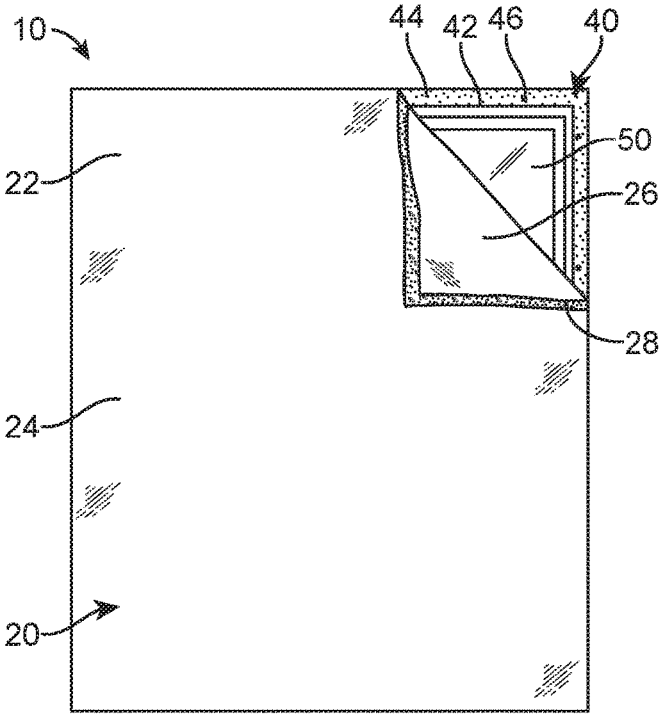
FIG. 2 shows a front view of the present invention in use wherein blackout shade 22 is slightly removed from the top right side of mounting assembly.
Figure 3:
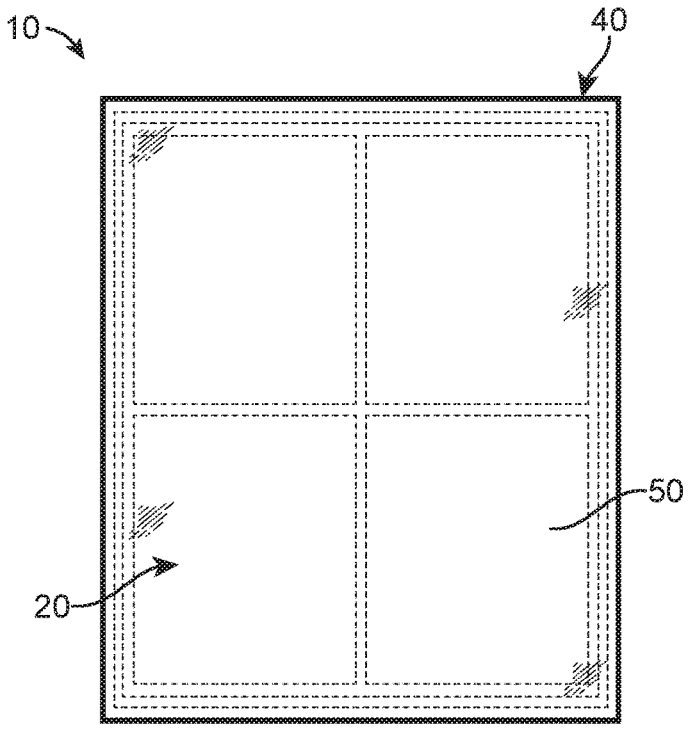
FIG. 3 illustrates a front view of the present invention in use wherein shade assembly 20 is mounted to a window 50 through mounting assembly 40.
Figure 4:
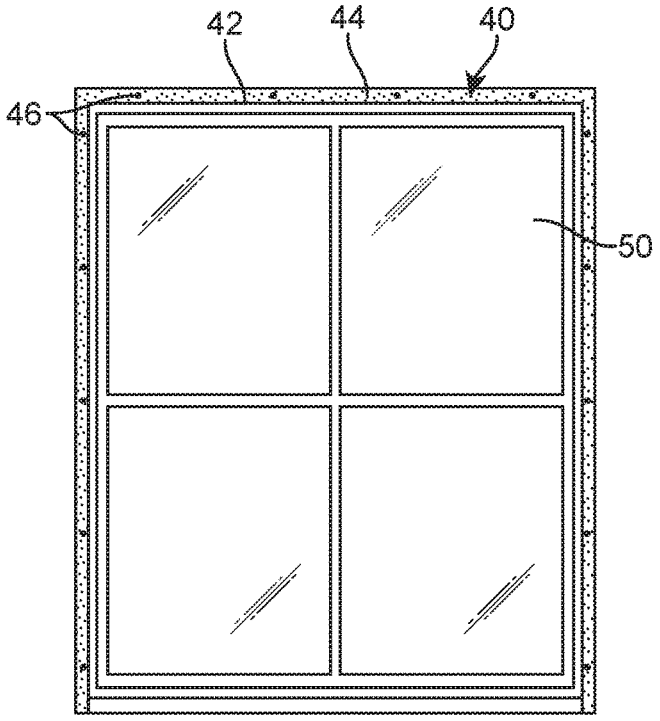
FIG. 4 is a representation of mounting assembly 40 mounted along the perimeter sides of window 50 except for the bottom perimeter of said window.

Referring now to the drawings, where the present invention is generally referred to with numeral 10, a blackout window covering system 10 can be observed that basically includes a shade assembly 20 and a mounting assembly 40.

Shade assembly 20 includes a blackout shade 22 and loop fasteners 28. Blackout shade 22 includes a frontside 24 and a backside 26. In one embodiment, blackout shade 22 is rectangular in shape to fit the common shape of a window 50 of a home. Window 50 comprises of four perimeter sides. However, it should be understood that the shape of blackout shade 22 may be adapted to fit the shape of any window of a house, building, or the like. Furthermore, blackout shade 22 may be made of a blackout fabric that is adapted to block light and absorb noise. Blackout shade 22 may also be comprised of any other suitable material adapted to block light and absorb noise. Loop fasteners 28 may be rectangular in shape and are located along the perimeter of backside 26 of said blackout shade 22. In the present embodiment, shade strips having loop fasteners 24 are sewn along the rectangular perimeter of backside 26 of blackout shade 22. In another embodiment, loop fastener 28 may be attached to backside 26 of blackout shade 22 through means of adhesives or any other attachment method. Shade assembly 20 is mounted to window 50 such that frontside 24 is facing the inside of a home.

Mounting assembly 40 includes mounting strips 42 and threaded fasteners 46. In the present embodiment, mounting strips 42 may be rectangular in shape and mounted along the perimeter of window 50 through means of threaded fasteners 46. However, one of the sides of the perimeter of window 50 is left unmounted with mounting strips 42. The present embodiment observes the bottom perimeter edge of window 50 absent of mounting strips 42 the remaining perimeter of window 50 includes said mounting strips 42. The absent perimeter side of mounting strips 42 allow a user to effortlessly remove shade assembly 20 from mounting assembly 40. It should be understood that additional embodiments may include mounting strips 42 mounted to the perimeter of a window 50 of any number of perimeter sides. Mounting strips 42 may be made of a vinyl material. Mounting strips 42 further includes hook fasteners 44 attached to said mounting strips 42 through means of adhesives. Threaded fasteners 46 are used to mount said mounting strips 42 including hook fasteners 44 to the perimeter of window 50. Loop fasteners 28 of shade assembly 20 and hook fasteners 44 of mounting strips 42 cooperate to form an attachment for shade assembly 20 and mounting assembly 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A blackout window covering system, comprising:

a. a shade assembly including a blackout shade of a rectangular shape comprising of a frontside and a backside, said backside includes four side edges that meet at four respective corners, said shade assembly further includes shade strips having loop fasteners mounted to the backside of said blackout shade;

b. a window having four perimeter sides, the window having a top edge and two lateral edges; and c. a mounting assembly including three mounting strips, said three mounting strips including an elongated rectangular shape and having hook fasteners, the three mounting strips being adhesively mounted and enveloping the window along said top edge and two lateral edges, the three mounting strips each having a mounting strip length, said three mounting strips include a mounting strip front side, said hook fasteners are affixed to said mounting strip front side, a threaded fastener being a plurality of screws mounting said three mounting strips to said top edge and the two lateral edges of the window, the plurality of screws being equally spaced along the top edge and the two lateral edges of the window.

2. The blackout window covering system of claim 1 wherein loop fasteners of the shade assembly and the hook fasteners of the mounting strips cooperate to form an attachment for the shade assembly and the mounting assembly.

3. The blackout window covering system of claim 1 wherein the blackout shade is made of a blackout fabric that is adapted to block light and absorb noise.

4. The blackout window covering system of claim 1 wherein the shade strips are rectangular in shape and are located along the perimeter of the backside of said blackout shade.

5. The blackout window covering system of claim 1 wherein the shade strips are sewn along the rectangular perimeter of the backside of the blackout shade.

6. The blackout window covering system of claim 1 wherein shade assembly is mounted to said window such that the frontside is facing an inside of a home.

7. The blackout window covering system of claim 1 wherein mounting strips are rectangular in shape and mounted along the perimeter of the window through means of threaded fasteners.

8. The blackout window covering system of claim 7 wherein one of the sides of the perimeter of the window is left unmounted with the mounting strips.

9. The blackout window covering system of claim 1 wherein the mounting strips are made of a vinyl material.

10. A blackout window covering system, consisting of:

a. a shade assembly including a blackout shade of a rectangular shape comprising of a frontside and a backside, the blackout shade being made of a pliable material, said blackout shade further includes three shade strips each having a shade strip length and loop fasteners mounted entirely along said shade strip length, said three shade strips being flush to a backside top edge and a backside two lateral edges, the three shade strips extending entirely along said backside top edge and the backside two lateral edges; and b. a window having four perimeter sides, said window including a cross section, wherein the cross section divides the window into four equal quadrants, the window having a top edge and two lateral edges; and c. a mounting assembly including three mounting strips, said three mounting strips including an elongated rectangular shape and having hook fasteners, the three mounting strips being adhesively mounted and enveloping the window along said top edge and two lateral edges, the three mounting strips each having a mounting strip length; and d. said mounting strip length is equal to said shade strip length, said loop fasteners cooperate with said hook fasteners to create a secure engagement; and e. said three mounting strips include a mounting strip front side, said hook fasteners are affixed to said mounting strip front side, a threaded fastener being a plurality of screws mounting said three mounting strips to said top edge and the two lateral edges of the window, the plurality of screws being equally spaced along the top edge and the two lateral edges of the window.

* * * * *